US006116500A

United States Patent [19]

Cahill

[11] Patent Number: 6,116,500

[45] **Date of Patent: *Sep. 12, 2000**

[54] COMPOSITE CONTAINER

[75] Inventor: Glenda J. Cahill, Florence, S.C.

[73] Assignee: Sonoco Development Inc., Hartsville, S.C.

[ * ] Notice: This patent issued on a continued prosecution application filed under 37 CFR 1.53(d), and is subject to the twenty year patent term provisions of 35 U.S.C. 154(a)(2).

[21] Appl. No.: 09/156,938

[22] Filed: Sep. 18, 1998

[51] Int. Cl.[7] ..... B65D 3/22

[52] U.S. Cl. ..... 229/120.32; 229/4.5; 229/5.5; 220/609; 426/119; 426/128; 206/830; 206/216

[58] Field of Search ..... 129/120.32, 5.6, 129/5.5, 4.5; 426/128, 119; 206/830, 217, 216; 220/609, 504, 503, 554

[56] References Cited

U.S. PATENT DOCUMENTS

| | | | |
|---|---|---|---|
| 1,128,266 | 2/1915 | Arnott | 229/5.5 X |
| 1,151,322 | 8/1915 | Wootten . | |
| 1,712,140 | 5/1929 | Flegenheimer . | |
| 1,891,535 | 12/1932 | Griffith | 229/5.5 X |
| 1,912,884 | 6/1933 | Bodor | 229/5.5 |
| 2,047,951 | 7/1936 | Eberhart . | |
| 2,082,614 | 6/1937 | Brodrick . | |
| 2,091,877 | 8/1937 | O'Neil . | |
| 2,404,485 | 7/1946 | Gleisner | 220/620 X |
| 2,406,758 | 9/1946 | Gazette | 220/620 X |
| 2,582,541 | 1/1952 | Harrison | 229/4.5 |
| 2,766,796 | 10/1956 | Tupper | 206/217 |
| 2,949,369 | 8/1960 | Zoeller et al. . | |
| 2,974,825 | 3/1961 | Ross . | |
| 3,015,429 | 1/1962 | Morici . | |
| 3,142,433 | 7/1964 | Balocca | 229/120.32 X |
| 3,182,890 | 5/1965 | Elam . | |
| 3,278,011 | 10/1966 | Viemeister | 206/830 |
| 3,385,503 | 5/1968 | Stump . | |
| 3,506,459 | 4/1970 | Parlour . | |
| 3,643,831 | 2/1972 | Casper . | |
| 3,826,359 | 7/1974 | Brecher | 206/216 |
| 3,851,757 | 12/1974 | Turpin . | |
| 4,114,784 | 9/1978 | Hough et al. . | |
| 4,266,689 | 5/1981 | Asher . | |
| 4,381,315 | 4/1983 | Yong et al. . | |
| 4,892,214 | 1/1990 | Hamaguchi et al. | 220/620 X |
| 5,115,938 | 5/1992 | Thompson | 229/620 X |
| 5,458,252 | 10/1995 | Logel . | |

FOREIGN PATENT DOCUMENTS

| | | | |
|---|---|---|---|
| 2682353 | 4/1993 | France | 229/235 |

*Primary Examiner*—Stephen P. Garbe
*Assistant Examiner*—Tri M. Mai
*Attorney, Agent, or Firm*—Alston & Bird LLP

[57] ABSTRACT

A container for containing a food product and an ancillary product is provided, which includes a tubular body formed of a paperboard material, at least one retaining rim formed by bending one of the ends of the tubular body radially inwardly, and a cup for holding ancillary products and separating and protecting the ancillary products from the food product. The cup has an open end which is in engagement with the retaining rim for retaining the cup within the tubular body. In this arrangement, the container is capable of withstanding internal pressure generated by packaged dough or other pressurized products without the use of expensive, opaque crimped metal ends, thereby overcoming deficiencies of conventional product and ancillary product containers. This arrangement permits the container to utilize transparent plastic ends so that consumers may observe the ancillary product packaged in the container and avoid food product discoloration frequently caused by metal ends.

21 Claims, 4 Drawing Sheets

COMPOSITE CONTAINER

FIELD OF THE INVENTION

This invention relates generally to containers for packaging of food and other products and, more particularly, to tubular containers made of paperboard material with end caps for packaging of refrigerated dough products under pressure.

BACKGROUND OF THE INVENTION

It is well-known to use an easy-open composite container for the packaging of raw, ready-to-bake, dough. In such a container, the container body, which is conventionally formed of paperboard, is torn open by the consumer to expose the container contents so as to enable the removal of individual dough cakes without substantial cake deformation. It is often desirable to include in such a container a quantity of icing or other topping for consumption with the cakes. As such, it is desirable to keep the topping separated from the cake dough so that each may be handled cleanly by the consumer.

The topping in such dough containers may be packed in a small open-ended plastic cup which, after being filled, is inserted, open end first, through an open end of the container body and pushed through the body until it seats against a closed end of the container. Such a container is disclosed in U.S. Pat. No. 3,182,890 to Elam. The plastic cup according to Elam is provided with an annular flange adjacent its closed end that is adapted to engage the interior side-wall of the container tube and form a seal that prevents the dough from extruding into the space between the cup and the side-wall.

The dough in a dough container may generate substantial pressure within the closed container during storage of the packaged dough product. The dough undergoes certain chemical reactions and generates gas pressure in a process known as "proofing." To withstand such pressure, containers usually have metallic "ends" configured to engage an end portion of the paperboard body, either through a process of crimping or seaming. The crimped metal ends retain the dough despite significant force acting indirectly through the plastic cup, at one end, or directly on the metal end, at the other end.

Composite packages which are able to withstand internal pressures such as those generated by refrigerated dough products are generally able to withstand pressures in the range of 8 to 35 psi inside the container. A crimped metal end allows gases to vent until the dough product seals off the gas vent paths, and internal pressure then builds until an equilibrium pressure is reached. The metal ends and the can of conventional dough containers are designed to withstand this equilibrium pressure so that the package remains intact over the shelf life of the product.

Unfortunately, the need to withstand significant internal dough-generated pressure has dictated the use of opaque metal ends which can be crimp seamed in conventional dough product packaging. With metal ends, the topping or other ancillary product in the cup is not visible to the consumer prior to purchase, and discoloration may result from the dough or other food products touching the metal ends. Visibility to the consumer may also have significant value in many other applications, such as when it is desirable to enclose a coupon or gift in the cup.

Therefore, there is a need in the industry for a composite container having a cup for ancillary products and which does not require metal ends for retaining the cup. Such a container would preferably retain the cup with little or no additional materials and be able to withstand pressures on the cup commensurate with those experienced with packages containing un-leavened dough. In addition, the contents of the cup would desirably be viewable by the consumer before purchase of the container.

SUMMARY OF THE INVENTION

These and other objects are provided, according to the present invention, by a container for containing a food product and an ancillary product, the container comprising a tubular body formed of a paperboard material, at least one retaining rim formed by bending one of the ends of the tubular body radially inwardly, and a cup for holding ancillary products and separating and protecting the ancillary products from the food product. According to the invention, the cup has an open end which is in engagement with the retaining rim for retaining the cup within the tubular body. The periphery of the open end of the cup is advantageously held in secure engagement with the retaining rim by internal pressure produced within the tubular body.

The cup also includes a cylindrical side-wall closed at one end by a dome-shaped convex end. The cylindrical side-wall of the cup has an outside diameter only slightly less than the diameter of the interior of the tubular body, providing a loose friction fit when the cup is positioned within the tubular body. The cylindrical side-wall of the cup preferably includes a thickened wall portion at an area where the cylindrical side-wall joins the dome-shaped convex end of the cup. The thickened wall portion defines an outside diameter in the thickened wall portion which is slightly greater than the outside diameter of the cylindrical side-wall and enhances the friction fit and seal created when the cup is positioned within the tubular body.

The outer surface of the cup maybe adhesively bonded to the inner surface of the tubular body for cup retention. The outer surface of the cup maybe bonded to a foil-lined inner surface of the tubular body through electromagnetic induction so as to retain the cup within the tubular body. The open end of the cup is maybe engagement with, and adhesively attached to, the retaining rim to retain the cup within the tubular body.

The container of the present invention can also include multiple cups held within the tubular body for holding ancillary products and protecting the ancillary products from the food product.

Consequently, the container of the present invention overcomes limitations imposed by conventional dough product and ancillary product containers. In particular, a container with an ancillary product cup is provided that can withstand the internal pressure generated by packaged dough or other pressurized products without the use of expensive, opaque crimped metal ends. The container may thereby employ transparent plastic end caps so that consumers may observe the ancillary product (a dough topping, coupon or gift, for example) packaged in the same container and so that food product discoloration caused by metal ends may thereby be avoided.

BRIEF DESCRIPTION OF THE DRAWINGS

Some of the objects and advantages of the invention have been set forth and other objects and advantages of the invention will become apparent in the detailed description of the preferred embodiments of the invention to follow, especially when taken in conjunction with the accompanying drawings, which are not necessarily drawn to scale.

DETAILED DESCRIPTION OF THE PREFERRED EMBODIMENTS

The present invention will now be described more fully with reference to the accompanying drawings, in which preferred embodiments of the invention are shown. The invention may, however, be embodied in many different forms and should not be construed as limited to the embodiments set forth herein; rather, these embodiments are provided so that this disclosure will be thorough and complete and will fully convey the scope of the invention to those skilled in the art. Like numbers refer to like elements throughout.

Figure 1:
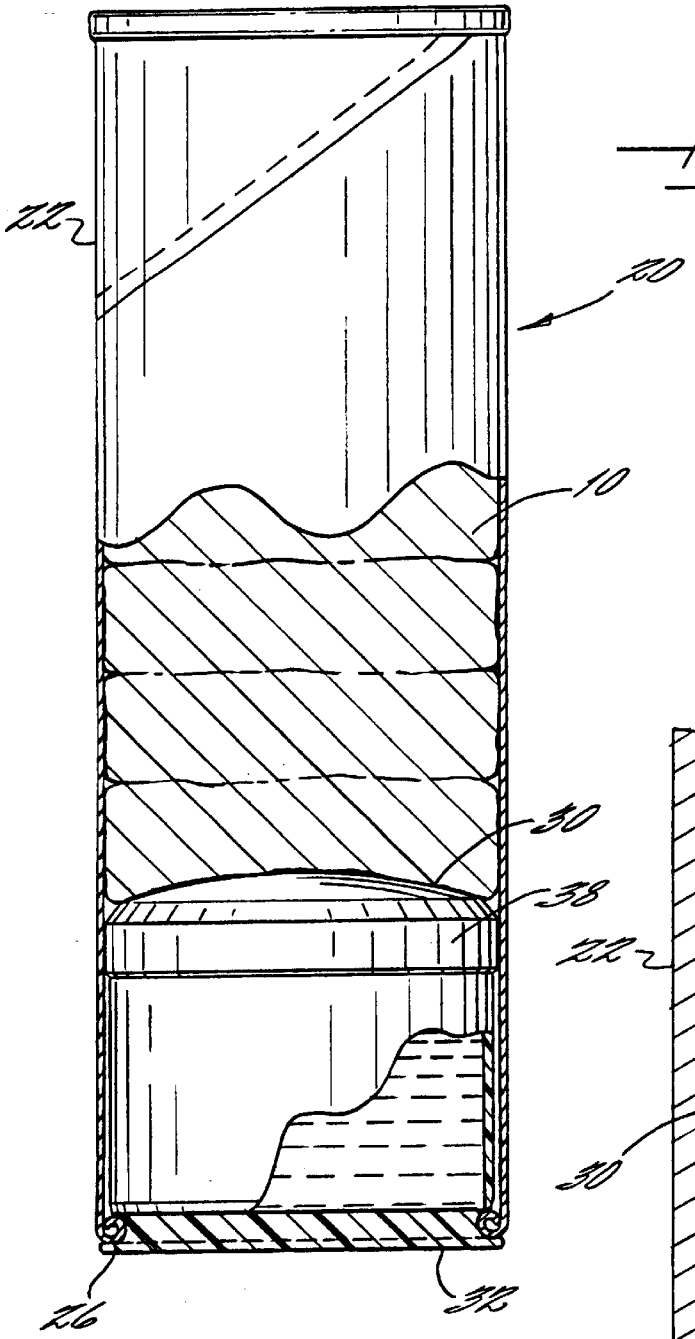
FIG. 1 is a partial section side view of a paperboard dough container with an ancillary product cup and constructed in accordance with the present invention.
Figure 6:
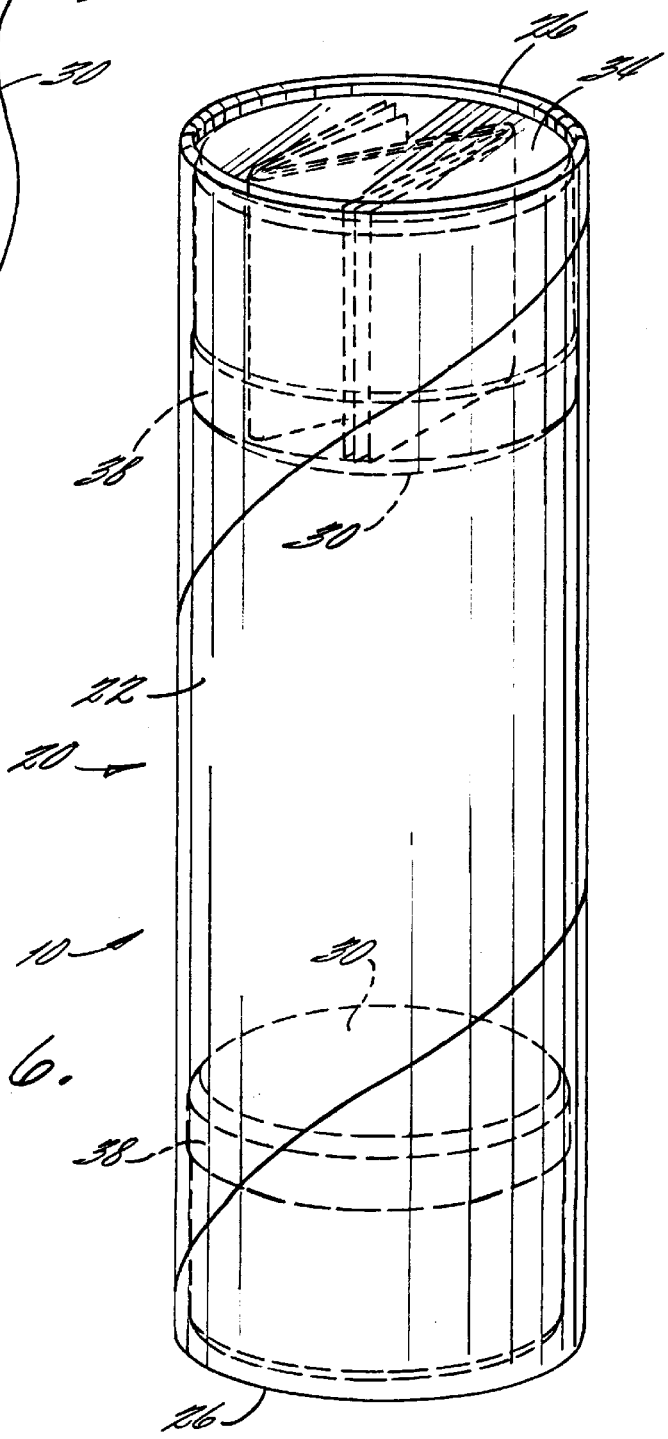
FIG. 6 is a cross-sectional view illustrating a dough container with two ancillary product cups.

FIG. 1 illustrates a composite container 20 for containing a food product, such as refrigerated dough 10, and an ancillary product, such as icing. While the illustrated embodiment and the following description describe the composite container of the present invention containing dough and icing, the container need not be used in conjunction with dough and icing, but may be used in conjunction with other leavened food products and other ancillary products known to those skilled in the art. For example, instead of icing, the ancillary product may be some other condiment, such as cheese or a coupon or gift as shown in FIG. 6.

The container 20 includes a tubular body 22 formed of a spirally wound paperboard material and at least one retaining rim 26. The retaining rim 26 is formed by rolling or turning one of the ends of the tubular body 22 radially inwardly. The retaining rim 26 may be in the form of a bead as shown, or may be some other configuration such as a flange or the like. The opposite end is closed with a conventional metal end closure 21 which is crimped or seamed to the paperboard body material. The container 20 also includes a cup 30 for holding ancillary products, such as icing 23, coupons or gifts 21, and separating and protecting the ancillary products from the dough 10. Preferably, the cup 30 is made of plastic or other similar material.

Figure 2:
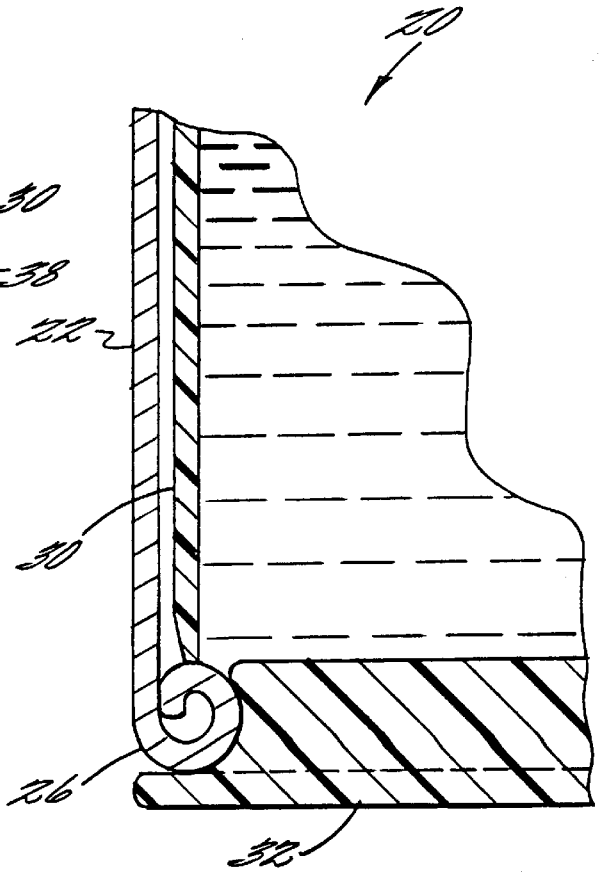
FIG. 2 is an enlarged cross-sectional view of the dough container and cup of FIG. 1 showing the cup engaged by an inward bead formed at the end of the tubular body to form a retaining rim.

FIG. 2 shows a cross-sectional view of one end of the container 20 for packaging the dough 10. The cup 30 is inserted open end first through the one end of the container 20 and pushed down through the body 22 until it seats against the retaining rim 26, which serves to prevent the cup 30 from being forced out of the container 20. The cup 30 could alternatively be inserted closed end first into the container 20 before the retaining rim 26 is formed. Advantageously, the retaining rim 26 is formed by rolling one of the ends of the body 22 radially inwardly. Even while the dough 10 inside the container 20 is stored in a refrigerator, the dough begins to "proof" within the container 20, urging the cup 30 against the retaining rim 26. The retaining rim 26 and the cup 30, by being in engagement with the retaining rim 26, withstand considerable pressure generated within the container 20.

Figure 4:
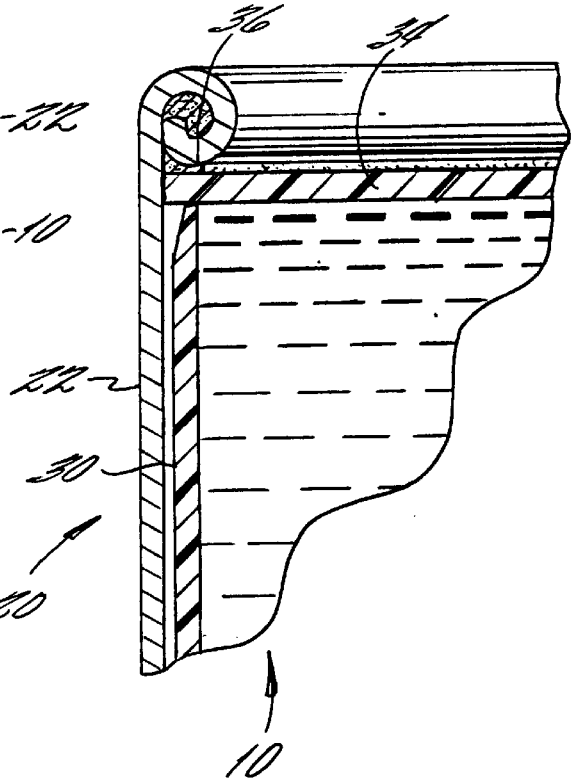
FIG. 4 is a cross-sectional view illustrating a dough container with an ancillary product cup and an end dish adhesively attached under an inwardly rolled bead at one end of the container.

The container 20 also includes an end cap 32, preferably made of a transparent plastic or other similar material. The end cap 32 snaps into place at the end of the container 20 to enclose the ancillary product within the cup 30. As shown in FIG. 4, an end disk 34 may also be used, or alternatively be used, in the end of the container 20. The end disk 34 is preferably made of a transparent plastic, such as PET, or other similar material and may be retained within the container 20 between the cup 30 and the retaining rim 26. The end disk 34 can increase burst strength over the situation where the open end of the cup 30 directly contacts the retaining rim 26. In this arrangement, consumers are advantageously able to observe the contents of the cup 30 through the end cap 32 and/or the end disk 34. Moreover, by employing plastic ends, the discoloration of food products which can result from prolonged contact between the food product and the metal end is avoided.

Figure 3:
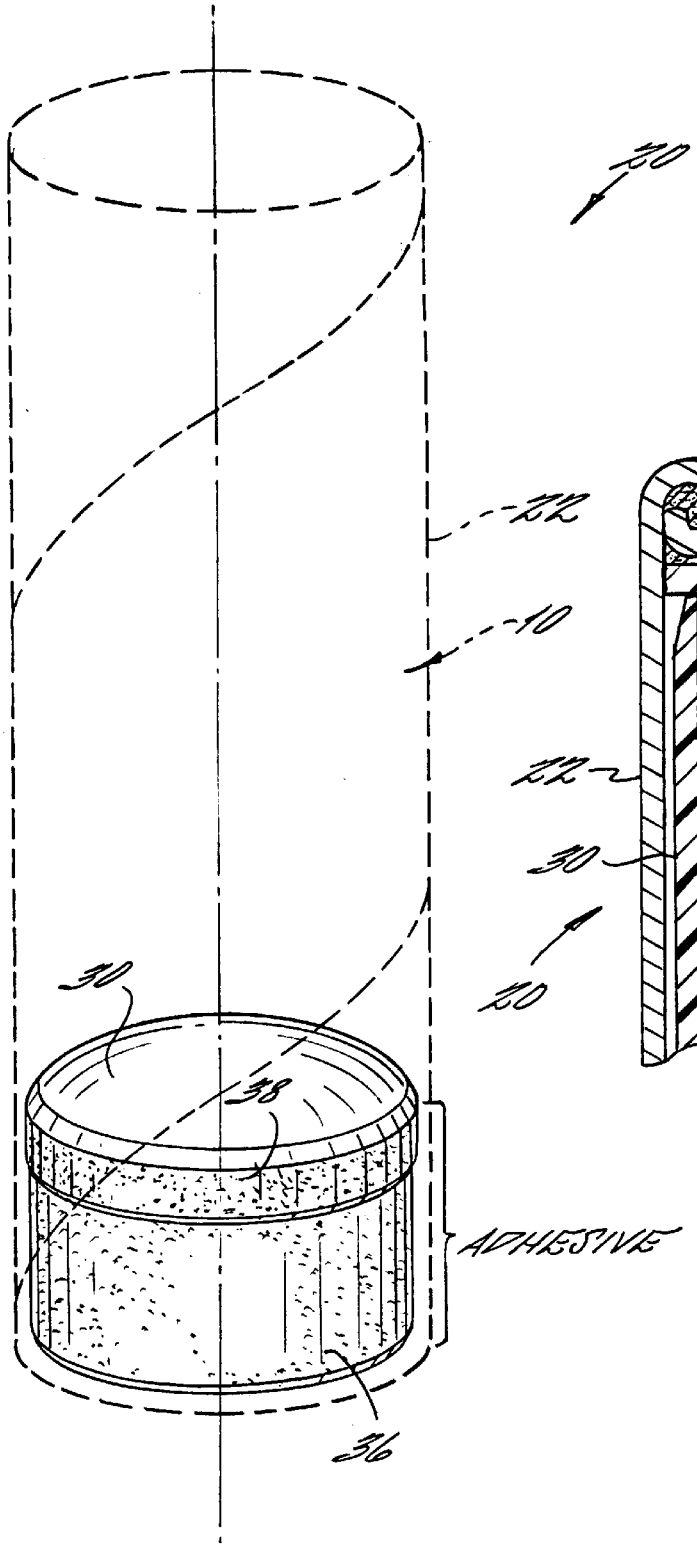
FIG. 3 is a diagrammatic perspective view illustrating a dough container with ancillary product cups attached inside the tubular body of the container with adhesive.

As demonstrated in FIG. 3, the retention strength for the cup 30 can alternatively be provided by way of an adhesive 36 on the outside surface of the cup 30, such as a hot melt adhesive, which bonds the outside surface of the cup 30 to the inside-wall of the body 22. The adhesive 36 fills between the cup 30 and the inner wall of the body 22 and, when cured, securely bonds the cup 30 to the body 22 of the container 20. The adhesive 36 may be introduced into the gap between the outer wall of the cup 30 and the inner wall of the container 20 by a variety of means as is known in the art.

The shear force resistance provided by the adhesive 36 serves to retain the cup 30 within the container 20 in the face of significant internal pressure caused by the leavened dough 10. It is to be understood that other structures and techniques that serve to bond the cup 30 to body 22 may be employed without departing from the present invention. In the embodiment shown in FIG. 4, for example, the adhesive 36 is applied behind the retaining rim 26 and is not applied between the outer surface of the cup 30 and the inner wall of the body 22. The adhesive 36 could also be applied both behind the retaining rim 26 and between the outer surface of the cup 30 and the inner wall of the body 22.

Figure 5:
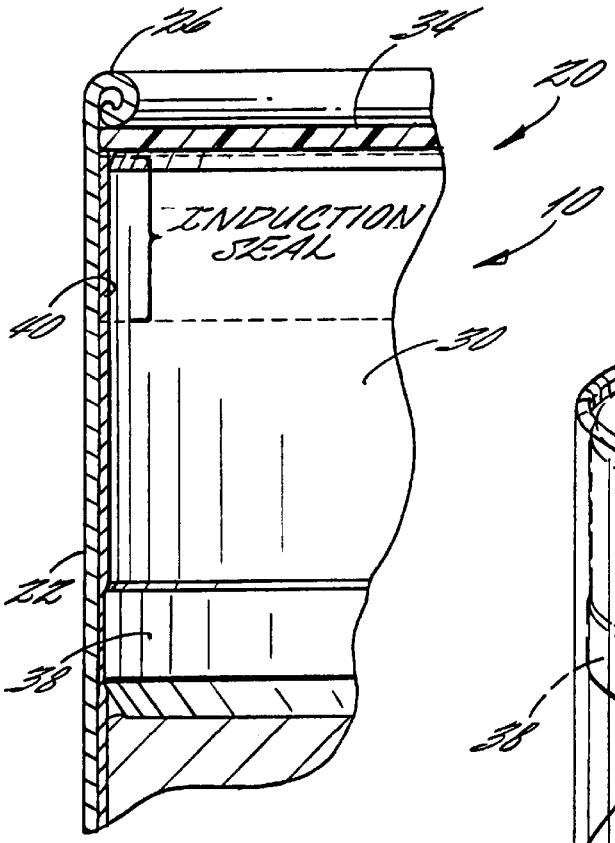
FIG. 5 is a cross-sectional view illustrating a dough container with an ancillary product cup sealed to the inside of the tubular body by induction heating.

As shown in FIG. 5, the container body 22 includes a liner 40. As is well known to those skilled in the art, the liner 40 serves as a moisture barrier throughout the entire container. The liner 40 can be formed entirely of polymeric material or can include a foil layer which provides the "barrier" properties and an overlying polymeric layer. The polymeric layer may be heated by an induction heating process to soften or melt the outside surface of the cup 30 and thereby bond the cup 30 to the body 22. The electromagnetic energy penetrates the liner 40 and causes the foil layer to heat rapidly, thereby heating the overlying polymeric layer and the outside surface of the adjacent cup 30. When the overlying polymeric layer and temperature reaches the softening or melting point of the cup material or the polymeric liner layer, the outside surface of the cup 30 bonds securely to the liner 40 formed on the inside surface of the body 22. The cup material is preferably a polymer such as HDPE but may also be other suitable materials known in the art. It is to be understood that other structures and techniques that serve to heat the outside surface of the cup 30 and to thereby bond the cup 30 to the body 22 may be employed without departing from the present invention. For example, FIG. 5 demonstrates an induction seal adjacent the open end of the cup 30. There may also be an induction seal, however, located at the closed end of the cup 30 adjacent a thickened wall portion 38.

Figure 7:
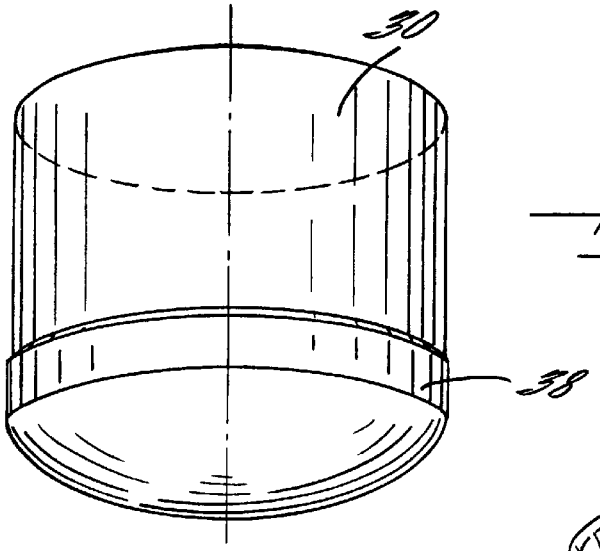
FIG. 7 is a perspective view of a cup for holding ancillary products specifically illustrating a thickened wall portion at the closed end of the cup.

As shown in FIG. 7, it is preferable for the cup 30 to include the thickened wall portion 38 about the periphery of the cup 30 near the closed end of the cup 30. The outer circumference of the thickened wall portion 38 should be slightly larger than the outer circumference of the remainder of the cup 30 and should result in an enhanced friction fit of the cup 30 within the body 22 of the container 20. The thickened wall portion 38 serves to prevent the pressurized dough 10 from extruding into the gap between the cup 30 and the container 20. In addition, the thickened wall portion 38 helps to create a container 20 having both a pressurized compartment where the dough is packaged and an unpressurized compartment where the ancillary product is packaged. The ability to package an ancillary product in an unpressurized compartment can especially be desirable in certain applications. An advantageous cup of this type is disclosed in copending U.S. patent application Ser. No. 08/865,082, which is assigned to the assignee of the present invention and incorporated herein by reference.

Figure 8:
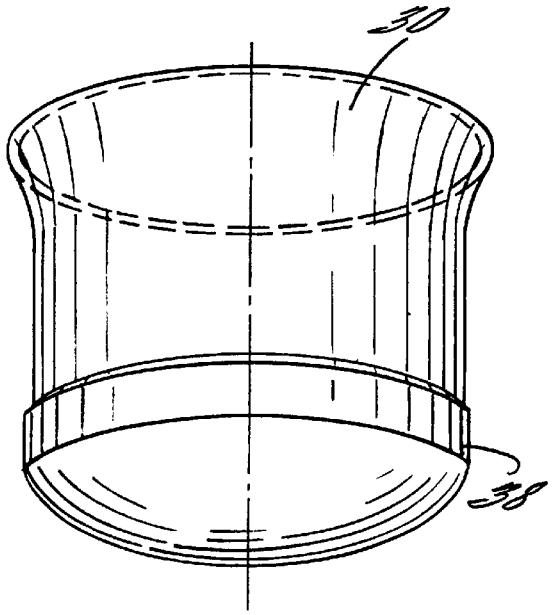
FIG. 8 is a perspective view of a cup for holding ancillary products with an open end that is flared outwardly.
Figure 9:
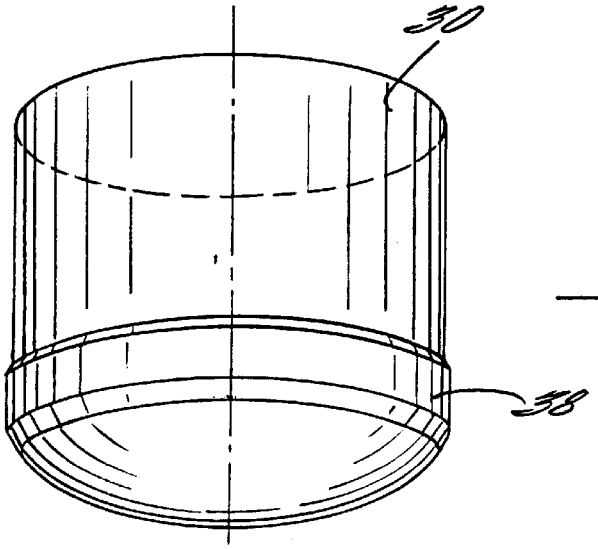
FIG. 9 is a perspective view of a cup for holding ancillary products with a beveled edge at its closed end.

It is also preferable that the closed end of the cup 30 be shaped to withstand the pressure exerted by the dough 10 without substantial deformation. As shown in FIG. 7, the closed end of the cup 30 may be dome shaped, for example, to provide the strength desired. Other shapes for the closed end of the cup 30 may be employed as are known in the art to provide strength to cup structures. For example, as shown in FIG. 9, the closed end of the cup 30 may have a beveled or chamfered surface 39. As shown in FIG. 8, alternative shapes may also be employed for the open end of the cup 30 to provide a better seal between the ancillary product in the cup 30 and the dough 10, such as flaring the open end of the cup 30 outward.

As shown in FIGS. 3 and 6, in one embodiment of the present invention two or more of the cups 30 may be retained within the container 20 and the contents of each of the two cups may be viewable thereby with the use of transparent plastic end caps 34 and/or end disks 32. For example, the icing 23 can be included in one cup 30, and a coupon 21, as shown in FIG. 6, can be included in the other cup 30.

In addition to the use of at least one retaining rim 26, induction sealing through induction seal liners 40 or adhesive sealing through the use of the adhesive 36 may be used to retain the cups 30 within the container 20, against pressure produced by dough "proofing", without the use of opaque metal end caps. While several methods of retaining the cup 30 within the container 20 are disclosed, it should be understood that two or more of these methods may be combined in a single container, as desired, to effect secure retention of the cup. In applications, where the side-wall of the cup 30 is adhered (whether through an adhesive or induction sealing) to the container 20, it is not necessary for the end of the paperboard material to be turned inwardly to help retain the cup 30. Turning the end is preferred, however, to prevent wicking of extrusion liquids into the end of the paperboard material. Testing has shown that an inwardly rolled bead alone can withstand pressures within the container up to 20 psi. Containers having a hot melt adhesive either within the bead 26 or around the side-wall of the cup 30 have been testing successfully up to pressures of 35 psi. For very high pressure applications, however, induction sealing of the cup 30 to the liner 40 has been successfully tested up to 45 psi.

Avoiding the use of metal end caps advantageously allows consumers to view the contents of both of the cups 30 and avoids the discoloration of food products which may result from prolonged contact between the food product and metal ends.

Consequently, the container 20 of the present invention overcomes limitations imposed by conventional dough and ancillary product containers. In particular, a container 20 with a cup 30 for holding ancillary products and separating and protecting the ancillary products from the food product is provided that can withstand the internal pressure generated by packaged dough or other pressurized products without the use of expensive, opaque crimped metal ends. The container 20 may thereby employ transparent plastic end caps 34 and/or end disks 32 so that consumers may observe the ancillary product (a dough topping, coupon or gift, for example) packaged in the same container 20. Food product discoloration caused by metal ends is also thereby avoided.

Many modifications and other embodiments of the invention will come to mind to one skilled in the art to which this invention pertains having the benefit of the teachings presented in the foregoing descriptions and the associated drawings. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation, the scope of the invention being set forth in the following claims.

That which is claimed is:

1. A container for containing a food product and an ancillary product, said container comprising:

a tubular body of a predetermined interior diameter and formed of a paperboard material, said tubular body having a pair of opposed ends;

at least one retaining rim formed by turning one of said ends of said tubular body radially inwardly; and a cup for holding the ancillary product and separating and protecting the ancillary product from the food product, said cup having an open end which is seated against said retaining rim for retaining said cup within said tubular body, said cup further comprising a generally cylindrical side-wall closed at one end by a dome-shaped convex end, said cylindrical side-wall having an outside diameter only slightly less than the diameter of the interior of said tubular body so as to provide a loose friction fit when said cup is positioned within said tubular body, and said cylindrical side-wall of said cup includes a thickened wall portion at an area thereof where said cylindrical side-wall joins said dome-shaped convex end to define an outside diameter in said thickened wall portion which is slightly greater than the outside diameter of said cylindrical side-wall to enhance the friction fit and seal created when said cup is positioned within said tubular body.

2. The container as defined in claim 1 wherein the periphery of the dome-shaped convex said cup is chamfered.

3. The container as defined in claim 2 or 1 wherein said retaining rim comprises an inwardly rolled bead.

4. The container as defined in claim 3 wherein the inwardly rolled bead is held in place by an adhesive.

5. The container as defined in claim 2 or 1 wherein the periphery of said open end of said cup is flared outwardly before engagement with said retaining rim.

6. The container as defined in claim 2 or 1 further comprising an end disk covering the open end of said cup.

7. The container as defined in claim 6 wherein said end disk is transparent.

8. The container as defined in claim 3 or 1 wherein said end closure member comprises an end cap held within said tubular body.

9. The container as defined in claim 8 wherein said end cap is transparent.

10. The container as defined in claim 2 or 1 further comprising at least one additional cup, held within said tubular body, for holding ancillary products and protecting the ancillary products from the food product.

11. A container for containing a food product and an ancillary product, said container comprising:

a tubular body of a predetermined interior diameter and formed of a paperboard material, said tubular body having a pair of opposed ends;

at least one retaining rim formed by turning one of said ends of said tubular body radially inwardly; and a cup for holding the ancillary product and separating and protecting the ancillary product from the food product, said cup having an open end which is seated against, and adhesively attached to, said retaining rim for retaining said cup within said tubular body, said cup further comprising a generally cylindrical side-wall closed at one end by a dome-shaped convex end, said cylindrical side-wall having an outside diameter only slightly less than the diameter of the interior of said tubular body so as to provide a loose friction fit when said cup is positioned within said tubular body, said cylindrical side-wall of said cup includes a thickened wall portion, at an area thereof where said cylindrical side-wall joins said dome-shaped convex end, to define an outside diameter in said thickened wall portion which is slightly greater than the outside diameter of said cylindrical side-wall to enhance the friction fit and seal created when said cup is position within said tubular body.

12. The container as defined in claim 11 wherein the periphery of the dome-shaped convex end of said cup is chamfered.

13. The container as defined in claim 12 or 1 wherein the periphery of said open end of said cup is flared outwardly.

14. The container as defined in claim 12 or 1 further comprising an end disk covering the open end of said cup.

15. The container as defined in claim 14 wherein said end disk is transparent.

16. The container as defined in claim 12 or 1 further comprising an end cap held within said tubular body.

17. The container as defined in claim 16 wherein said end cap is transparent.

18. The container as defined in claim 12 or 1 further comprising at least one additional cup, held within said tubular body, for holding ancillary products and protecting the ancillary products from the food product.

19. A container for containing a food product and an ancillary product, said container comprising:

a tubular body of a predetermined interior diameter and formed of a paperboard material, said tubular body having a pair of opposed ends;

at least one retaining rim formed by turning one of said ends of said tubular body radially inwardly to reduce said interior diameter of said tubular body at said retaining rim;

a cup for holding the ancillary product and separating and protecting the ancillary product from the food product, said cup comprising a generally cylindrical side-wall and including a closed end and an open end, said closed end comprises a dome-shaped convex end having a chamfered periphery, said cylindrical side-wall having an outside diameter only slightly less than the diameter of the interior of said tubular body so as to provide a loose friction fit when said cup is positioned within said tubular body and so that said retaining rim will prevent movement of said cup outside of said tubular body of said container; and an end closure member cooperating with said retaining rim to close said one of said ends of said tubular body with said ancillary product cup therein.

20. The container as defined in claim 19 wherein said open end of said cup is adhesively attached to said retaining rim.

21. The container as defined in claim 19, wherein said cylindrical side-wall of said cup is bonded to an inner surface of said tubular body of said container.

* * * * *

UNITED STATES PATENT AND TRADEMARK OFFICE
CERTIFICATE OF CORRECTION

PATENT NO. : 6,116,500

DATED : September 12, 2000

INVENTOR(S) : Cahill

It is certified that error appears in the above-identified patent and that said Letters Patent is hereby corrected as shown below:

Column 7, line 2, after "convex" insert --end of--; lines 3, 7, 10 and 19, "claim 2", each occurrence, should read --claim 19--; line 14, "claim 3" should read --claim 19--.

Column 8, lines 4, 6, 10 and 14, "claim 12", each occurrence, should read --claim 20--.

Signed and Sealed this

First Day of May, 2001

*Attest:*

Nicholas P. Godici

NICHOLAS P. GODICI

*Attesting Officer*

*Acting Director of the United States Patent and Trademark Office*